United States Patent [19]

Betts

[11] Patent Number: 4,488,490

[45] Date of Patent: Dec. 18, 1984

[54] PERCUSSION INITIATED SPOTTING CHARGE

[75] Inventor: Robert E. Betts, Huntsville, Ala.

[73] Assignee: The United States of America as represented by the Secretary of the Army, Washington, D.C.

[21] Appl. No.: 527,714

[22] Filed: Aug. 29, 1983

[51] Int. Cl.[3] ..... F42B 11/16

[52] U.S. Cl. ..... 102/513; 102/204

[58] Field of Search ..... 102/204, 501, 507, 513

[56] References Cited

U.S. PATENT DOCUMENTS

| | | | |
|---|---|---|---|
| 33,495 | 10/1861 | Schenkl | 102/70 |
| 1,540,283 | 6/1925 | Remondy | 102/70 |
| 1,702,133 | 2/1929 | Remondy | 102/70 |
| 2,764,092 | 9/1956 | Massey | 102/204 |
| 3,143,966 | 8/1964 | Burns, Jr. et al. | 102/507 |
| 3,238,877 | 5/1966 | Simmons | 102/70 |
| 3,440,963 | 4/1969 | De Luca | 102/513 |
| 3,861,311 | 1/1975 | Bilsbury | 102/515 |
| 4,341,573 | 7/1982 | Donoho | 149/42 |

*Primary Examiner*—Harold J. Tudor

*Attorney, Agent, or Firm*—Anthony T. Lane; Robert P. Gibson; James T. Deaton

[57] ABSTRACT

A precussion initiated spotting charge in which the spotting charge is carried by the front end of a solid propellant rocket and has a priming charge which is specifically mounted in a forward section of the housing for the spotting charge in a lead support structure with a strengthening outer structure for supporting the lead structure relative to the spotting charge body structure.

4 Claims, 5 Drawing Figures

PERCUSSION INITIATED SPOTTING CHARGE

DEDICATORY CLAUSE

The invention described herein may be manufactured, used, and licensed by or for the Government for governmental purposes without the payment to me of any royalties thereon.

BACKGROUND OF THE INVENTION

In the past, a percussion initiated spotting charge has been used as an explosive warhead on small practice rockets. One such explosive warhead includes a spotting head employing a stab primer for initiation of the spotting charge. In this device as illustrated in FIGS. 1, 2, and 3, the firing pin used to initiate the primer prior to launch is held off the primer by a spring-weight arrangement as illustrated in FIG. 1. On acceleration as illustrated in FIG. 2, the weight with the hole in its center compresses the spring and locks to the firing pin with the tip end of the firing pin protruding through the weight as illustrated. On deceleration as illustrated in FIG. 3, the spring-weight firing pin moves forward striking the primer and setting off the body charge. Such an arrangement has safety problems in handling prior to and during launch. Also, one disadvantage is that mechanical mechanisms tend to hang-up on deceleration and causes non-functioning on soft target. Hang-up also causes non-arming on acceleration as well. Therefore, it can be seen that there is a need for a device that has no moving parts, that is safe to operate and handle, and that is reliable in operation.

Accordingly, it is an object of this invention to provide a percussion initiated spotting charge for a solid propellant rocket that has no moving parts.

Another object of this invention is to provide a percussion initiating spotting charge in which each of the elements are made from relatively inexpensive materials but yet reliable.

Still another object of this invention is to provide a relatively light and compact percussion initiated spotting charge arrangement.

Other objects and advantages of this invention will be obvious to those skilled in this art.

SUMMARY OF THE INVENTION

In accordance with this invention, a solid propellant rocket motor is provided with a motor closure head and with a percussion initiated spotting charge mounted on the motor closure head. The percussion initiated spotting charge includes a body made of a material sufficient for withstanding the acceleration forces and has a chamber with a pyrotechnic contained therein and said body has at one end thereof a lead material that is supported with a jacket material inside a front portion of the body structure and the lead structure has a percussion primer mounted at one end thereof and a chamber and hole communicates from the percussion primer to the pyrotechnic to cause the percussion primer to be communicated directly with the pyrotechnic and set the pyrotechnic charge off upon contacting a target.

DESCRIPTION OF THE PREFERRED EMBODIMENT

Figure 1:
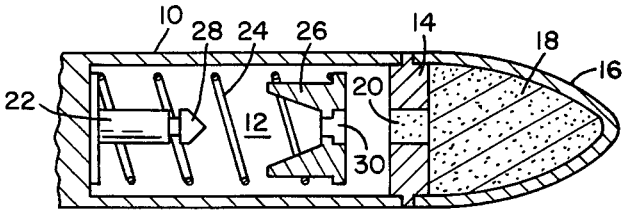
FIG. 1 is a view of a percussion initiated spotting charge at rest.
Figure 2:
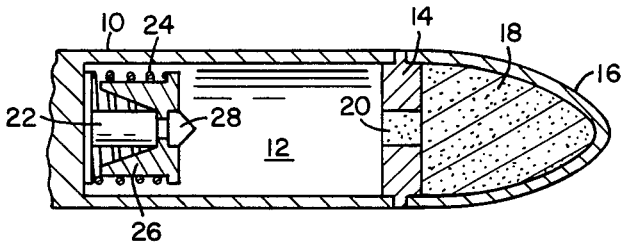
FIG. 2 is a view of a percussion initiated spotting charge as it is being accelerated.
Figure 3:
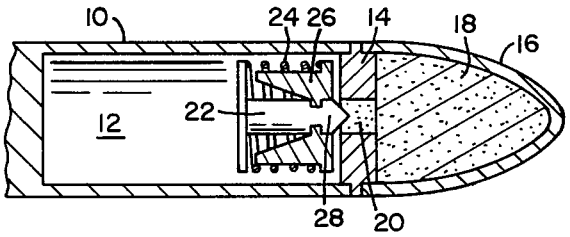
FIG. 3 is a view of a percussion initiated spotting charge illustrating the position of the various elements upon deceleration or target contact of the various elements.

Referring now to the drawing, in FIGS. 1, 2 and 3, the prior art is illustrated and includes a head structure 10 that has an internal cavity 12 with a primer block 14 mounted at a forward end of the head and an o-give closure structure 16 that has a flash charge 18 mounted therein. Primer block 14 has a stab primer 20 mounted therein and cavity 12 has a firing pin 22 slidably mounted therein with a spring 24 positioned between firing pin 22 and weight structure 26. This device is designed for weight or mass 26 to move against spring 24 and cause end 28 of firing pin 22 to be engaged through opening 30 of mass 26 upon acceleration. On contact of o-give end 16 with a target, the device decelerates and end 28 impacts with stab primer 20 setting off this primer charge which in turn sets off flash charge 18. As can be seen, this mechanical arrangement is susceptible to mechanical failure.

Figure 4:
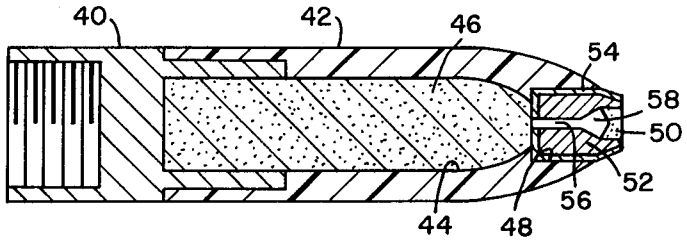
FIG. 4 is an enlarged view illustrating the percussion initiated spotting charge in accordance with this invention.
Figure 5:
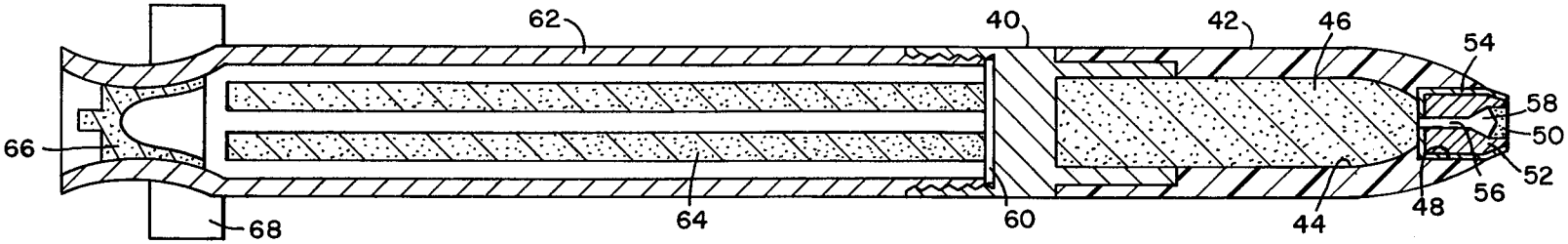
FIG. 5 is a view of a rocket motor with the percussion initiated spotting charge mounted at the front end of the rocket.

Referring now to FIG. 4, a very compact and precision built percussion initiated spotting charge in accordance with this invention is disclosed and includes a motor head closure 40 with a body 42 of a light weight material sufficient to stand the acceleration forces such as a light nylon material is connected to motor head structure 40 and body 42 has a cavity 44 therein that is filled with a pyrotechnic spotting charge 46. Spotting charge 46 is preferably made as a pyrotechnic which has by weight, 24 percent aluminum powder, 66 percent potassium perchlorate and 10 percent sulfur. This has been found to be a good pyrotechnic for this type spotting charge. The front end of body 42 has a bore 48 therein that receives the structure that mounts percussion primer 50. Percussion primer 50 is mounted in a lead structure 52 that is supported by a supporting jacket 54 that is made of copper or other equivalent material. It is noted that jacket 54 completely closes the outer circumference of body 52 as well as one end of body 52. Body 52 has a bore 56 and a cavity 58 that communicate the percussion primer charge to the pyrotechnic spotting charge 46 when percussion primer 50 is set off by impact of percussion primer 50 with a target.

Motor head closure 40 is designed for clamping propellant plate holder 60 to one end of rocket motor case 62 as illustrated. Propellant holder plate 60 positions propellant sticks 64 within rocket motor case 62. The rear end of rocket motor case 62 has a conventional ignitor and closure 66 for closing the rocket motor chamber and for igniting the rocket motor when desired. The rocket motor case also has conventional fin structure 68 for stabilizing flight of the rocket.

In operation, when it is desired to fire the rocket, ignitor 66 is initiated to ignite propellant 64 and cause the rocket to be launched toward the desired target. When percussion primer 50 strikes the target, percussion primer 50 is set off and the explosion thereof is communicated through chamber 58 and passage 56 to pyrotechnic spotting charge 46 and this charge is then set off. As can be readily seen, this specific arrangement provided by applicant is much more compact and much more efficient than that of the mechanical prior art and a device of this nature is almost fail proof. It is also pointed out that this particular arrangement is much lighter and much more compact than that of the prior device. Therefore, it lends itself much more readily to the rocket environment.

I claim:

1. A rocket having a percussion initiated spotting charge comprising a head closure, and elongated body secured to said head closure and having a chamber defined therein and having an outer surface that is tapered inwardly at the leading front end thereof, a pyrotechnic spotting charge positioned in and filling said chamber of said elongated body, said elongated body having a bore opening in the leading and front end thereof and extending to said chamber, a percussion primer mounted in a leading end portion of a malleable body and said malleable body having a chamber defined therein and having a passage therein from the chamber thereof to a remote end of the malleable body that is adjacent said pyrotechnic spotting charge and a jacket on an outer radial surface of said malleable body and on an end of said malleable body remote from said percussion primer, said passage continuing through said jacket at said end and said malleable body and said jacket being secured in said bore opening of said elongated body with a portion of said jacket end in contact with said pyrotechnic spotting charge and an opposite leading end that projects beyond the front end of said bore opening, whereby when the rocket is launched toward a target and said percussion primer strikes said target, said percussion primer will be set off and the explosion thereof will be communicated through said chamber and said passage directly to the pyrotechnic spotting charge to in turn set off the pyrotechnic spotting charge.

2. A rocket having a percussion initiated spotting charge as set forth in claim 1, wherein said pyrotechnic spotting charge consists of an aluminum powder of about 24 weight percent, potassium perchlorate of about 66 weight percent, and sulfur of about 10 weight percent.

3. A rocket having a percussion initiated spotting charge as set forth in claim 2, wherein said malleable body is lead, and said jacket is made of copper material to support the lead within the opening of the elongated body.

4. A rocket having a percussion initiated spotting charge as set forth in claim 3, wherein said elongated body is made of nylon to provide a light body.

* * * * *